US009480135B2

(12) United States Patent
Kwon

(10) Patent No.: US 9,480,135 B2
(45) Date of Patent: Oct. 25, 2016

(54) HIGH VOLTAGE TUBE TANK FOR A PORTABLE X-RAY

(71) Applicant: Young Bae Kwon, Seoul (KR)

(72) Inventor: Young Bae Kwon, Seoul (KR)

(73) Assignee: INNODEN, LLC, Renton, WA (US)

( * ) Notice: Subject to any disclaimer, the term of this patent is extended or adjusted under 35 U.S.C. 154(b) by 67 days.

(21) Appl. No.: 14/479,333

(22) Filed: Sep. 7, 2014

(65) Prior Publication Data

US 2016/0073485 A1 Mar. 10, 2016

(51) Int. Cl.

| | |
|---|---|
| ***H05G 1/02*** | (2006.01) |
| ***H01J 35/02*** | (2006.01) |
| ***H05G 1/06*** | (2006.01) |
| *H05G 1/22* | (2006.01) |

(52) U.S. Cl.

CPC ..... *H05G 1/06* (2013.01); *H01J 35/025* (2013.01); *H05G 1/22* (2013.01)

(58) Field of Classification Search

CPC ..... H05G 1/02; H05G 1/04; H05G 1/06; H05G 1/08; H01J 35/02; H01J 35/025; H01J 35/16

See application file for complete search history.

(56) References Cited

U.S. PATENT DOCUMENTS

| | | | | | |
|---|---|---|---|---|---|
| 4,646,338 | A * | 2/1987 | Skillicorn | H01J 35/04 | 378/102 |
| 4,694,480 | A * | 9/1987 | Skillicorn | H01J 35/12 | 378/102 |
| 4,920,554 | A * | 4/1990 | Gabbay | H01J 35/16 | 378/200 |
| 5,077,771 | A * | 12/1991 | Skillicorn | H01J 35/16 | 378/102 |
| 5,384,821 | A * | 1/1995 | Jedlitschka | H05G 1/025 | 378/193 |
| 5,517,545 | A * | 5/1996 | Nakamura | H05G 1/06 | 378/101 |
| 6,038,287 | A * | 3/2000 | Miles | A61B 6/14 | 378/117 |
| 6,775,353 | B2 * | 8/2004 | Thandiackal | H01J 35/16 | 378/119 |
| 7,305,065 | B2 * | 12/2007 | Takahashi | H05G 1/12 | 378/101 |
| 7,496,178 | B2 * | 2/2009 | Turner | A61B 6/4405 | 378/101 |
| 8,331,533 | B2 * | 12/2012 | Yamamoto | H01J 35/025 | 378/101 |
| 8,675,817 | B2 * | 3/2014 | Ogata | H01J 35/045 | 378/101 |
| 9,070,531 | B2 * | 6/2015 | Ueda | H05G 1/025 | |
| 2003/0081730 | A1 * | 5/2003 | Thandiackal | H01J 35/16 | 378/121 |
| 2010/0310053 | A1 * | 12/2010 | Yamamoto | H01J 35/025 | 378/200 |
| 2012/0027179 | A1 * | 2/2012 | Ogata | H01J 35/045 | 378/101 |
| 2014/0029725 | A1 * | 1/2014 | Ueda | H05G 1/025 | 378/62 |
| 2014/0211923 | A1 * | 7/2014 | Chen | H05G 1/025 | 378/105 |
| 2014/0270083 | A1 * | 9/2014 | Dinsmore | H01J 35/025 | 378/109 |

* cited by examiner

*Primary Examiner* — Thomas R Artman
(74) *Attorney, Agent, or Firm* — Jon C. Gealow

(57) ABSTRACT

The high voltage tube tank of x-ray system is embodied by miniaturizing the portable x-ray system for better mobility and portability. The high voltage tube tank of portable x-ray system comprising of an xray tube for generating x-rays, a high voltage transformer for generating high voltage, a high voltage rectification circuit for transforming and boosting AC voltage to DC voltage, and a housing for storing the apparatuses thereof, is configured in such a way that the high voltage rectification circuit is comprised of multiple high voltage capacitors linearly aligned on both sides of the circuit board and the high voltage diode built between the confronting high voltage capacitors, wherein the x-ray tube is placed between the high voltage capacitors thereof.

5 Claims, 3 Drawing Sheets

HIGH VOLTAGE TUBE TANK FOR A PORTABLE X-RAY

SPECIFICATION TECHNICAL FIELD

The present invention is about a high voltage tube tank of x-ray system, and in detail, it relates to the high voltage tube tank of portable x-ray system embodied by miniaturizing the portable x-ray system for better Mobility and portability.

BACKGROUND OF THE INVENTION

In general, the x-ray system has been frequently used for medical or industrial purposes. The xray system is comprised of an x-ray tube for generating x-rays, a high voltage transformer for generating high voltage and a high voltage rectification circuit for transforming and boosting AC voltage to DC voltage.

FIG. 1 illustrates a block diagram of the existing x-ray system, and the conventional x-ray system is structured in such a way that an x-ray tube 10, a high voltage transformer 20 and a high voltage rectification circuit 30 are embedded in a high voltage tank tube.

The high voltage tank tube of the conventional system requires a compact structure for realizing mobility and portability. Thus, the case 1 of the high voltage tube tank is manufactured in such a way that the entire inner wall is usually shielded by insulators 2 or that the ends of the high voltage circuit means are wrapped by insulators to prevent discharge of high voltage.

In detail, as illustrated in FIG. 1, the inner wall of the high voltage tube tank is shielded by insulators 2 and the inner space is divided by a partition 3 to maintain the fixed distance among the high voltage apparatuses. In addition, the rooms of the parted case are filled with insulating oil L to prevent discharge of high voltage generated among the storing high voltage circuit means. The rooms thereof store the x-ray tube 10, a high voltage circuit means, and the high voltage transformer 20 and high voltage rectification circuit 30, away from the x-ray tube. The x-ray tube 10, the high voltage transformer 20 and the high voltage rectification circuit 30 are electrically connected by wirings 4, 5, and the electrical connection thereof is established in such a way that the wiring is led from the high voltage transformer 20 to the high voltage rectification circuit 30 to the x-ray tube 10. The un-described symbol '12' indicates an anode and '11' indicates a cathode.

The conventional high voltage tube tank has a square-shaped hexahedral structure, and in the case 1 of the parted tube tank, an x-ray tube 10, a high voltage transformer 20 and a high voltage rectification circuit 30 are built in the far distance from one another, and the remaining inner space is all filled with insulating oil L. Thus, the overall volume and weight of the high voltage tube tank increases, making it difficult to embody miniaturization and weight reduction. That is, the conventional high voltage tube tank has faced a problem of poor mobility and portability owing to difficulties in miniaturization and weight reduction.

Description of Invention Solution Task

The present inventions is created to solve the problem thereof, and the size of the tube tank in the portable x-ray system may be reduced innovatively, and the purpose of the present invention is to provide a high voltage tube tank of portable x-ray system with enhanced insulation against high voltage.

Method of Solution

In accordance with one embodiment of the present invention to achieve the purpose thereof, a high voltage tube tank of portable x-ray system comprising of an x-ray tube for x-ray generation, a high voltage transformer for high voltage generation, a high voltage rectification circuit for transforming and boosting AC voltage to DC voltage, and a housing for storing the apparatuses thereof, is configured in such a structure that the high voltage rectification circuit is comprised of multiple high voltage capacitors linearly aligned on both sides of the circuit board, and the high voltage diode built between the confronting high voltage capacitors thereof, wherein the x-ray tube is placed between the high voltage capacitors.

The housing thereof, includes a casing with open top and shielded bottom, and a terminal PCB for shielding the open top of the casing, wherein the elevated platform is built at the open end of the casing, and a clamp is installed on the elevated platform thereof, enabling the terminal PCB to be fixed from inside of the casing through the clamp.

In the housing thereof, the inner wall placed on the anode side of the x-ray tube in the housing is thicker than other inner walls.

The fixing plate may be installed on the circuit plate and the x-ray tube to fix the x-ray tube thereof.

The fixing plate thereof is made of insulation materials to protect the x-ray tube from voltage drop generated from the high voltage rectification circuit.

EFFECT OF INVENTION

In accordance with the present invention, the size of the tube tank in the portable x-ray system may be innovatively reduced by placing the x-ray tube on the high voltage rectification circuit, and the insulation structure built in the housing may restrain discharge phenomenon generated between the parts caused by high voltage.

DETAILED DESCRIPTION OF EMBODIMENTS

Some desirable embodiments are described in detail hereinafter with reference to the figures. With regard to describing the present invention, it should be noted that the terms used to describe the components of the present invention are intended to correspond to the function performed by the respective components, and they are not intended as a limitation on the technological scope of the present inventions.

Figure 2A:
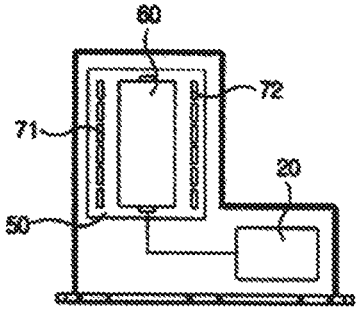
FIG. 2*a* is a block diagram illustrating the placement of x-ray tube in the high voltage tube tank of portable x-ray system in accordance with an embodiment of the present invention.
Figure 2B:
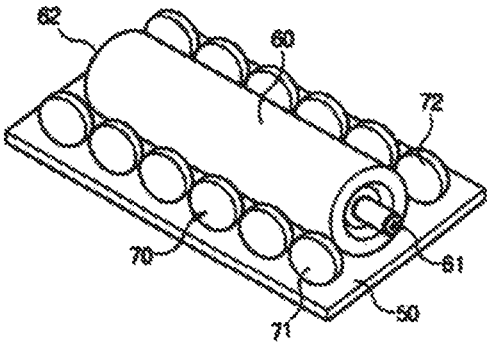
FIG. 2*b* is a three-dimensional diagram illustrating the placement of x-ray tube in the high voltage tube tank of portable x-ray system in accordance with an embodiment of the present invention.
Figure 3:
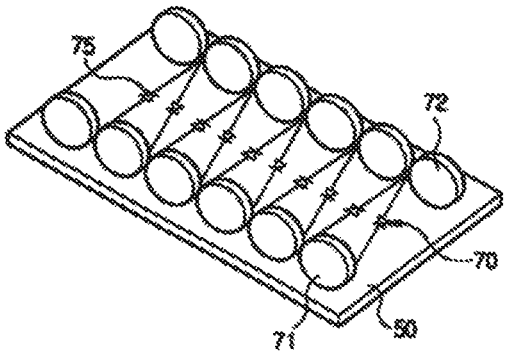
FIG. 3 is a three-dimensional diagram illustrating the high voltage circuit board in the high voltage tube tank of portable x-ray system in accordance with an embodiment of the present invention.
Figure 4:
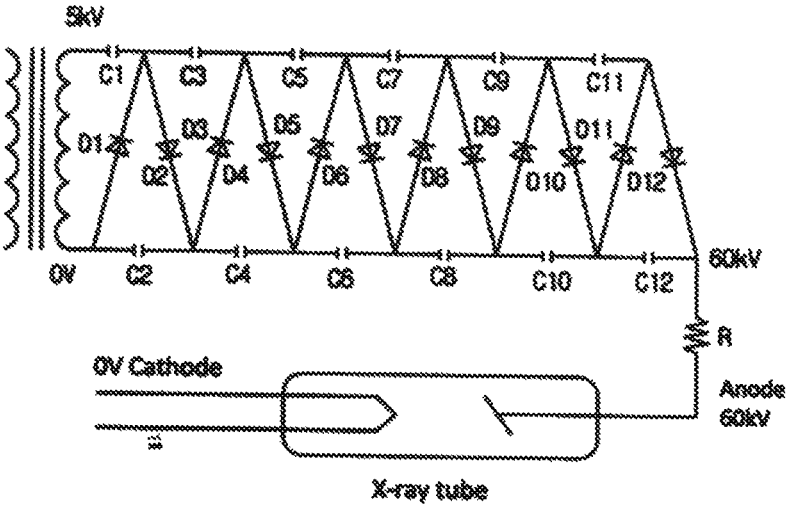
FIG. 4 is a connection diagram of the x-ray tube and high voltage circuit board in the high voltage tube tank of portable x-ray system in accordance with an embodiment of the present invention.

FIG. 2*a* is a block diagram illustrating the placement of x-ray tube in the high voltage tube tank of portable x-ray system in accordance with an embodiment of the present invention;

FIG. 2*b* is a three dimensional diagram illustrating the placement of x-ray tube in the high voltage tube tank of portable xray system in accordance with an embodiment of the present invention;

FIG. 3 is a three-dimensional diagram illustrating the high voltage circuit board in the high voltage tube tank of portable x-ray system in accordance with an embodiment of the present invention; and FIG. 4 is a connection diagram of the xray tube and high voltage circuit board in the high voltage tube tank of portable x-ray system in accordance with an embodiment of the present invention.

Figure 1:
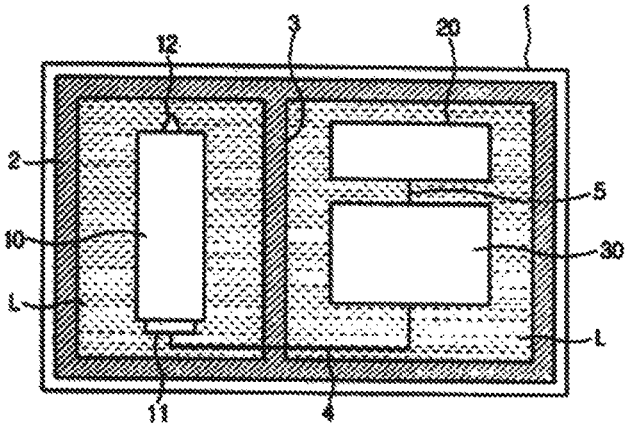
FIG. 1 is a block diagram of the conventional x-ray system.

The high voltage tube tank of the present invention has the same structure as the conventional xray system shown in FIG. 1 and thus, the detailed operational description is omitted.

As illustrated in FIG. 2*a* and FIG. 3, the high voltage tube tank of portable x-ray system of the present invention is configured in such a way that the multiple high voltage capacitors 71, 72 are placed linearly, and the x-ray tube 60 is placed between these high voltage capacitors thereof 71, 72 to enable miniaturization of the system. As illustrated in FIG. 3, the high voltage rectification circuit 70 may be configured in such a way that the high voltage diode 75 is placed between the high voltage capacitors 71, 72 on the circuit board 50.

In detail, the present invention puts emphasis on minimizing the area occupied by the parts of high voltage circuit while placing the parts thereof in a way that prevents discharge of high voltage.

To address the above issue, the high voltage rectification circuit 70 is composed of the Cockcroft-Walton circuit as illustrated in FIG. 4. In the Cockcroft-Walton circuit, multiple high voltage capacitors 71, 72 are placed in series and the high voltage diode 75 is placed between the high voltage capacitors thereof, thereby boosting the secondary voltage of the high voltage transformer 20; refer to FIG. 2*a* up to the number of the high voltage capacitors 71, 72 to obtain the desired high DC voltage.

In the Cockcroft-Walton circuit thereof, the same amount voltage as the input voltage is charged into the high voltage capacitors 71, 72 and the sum of the voltage charged into the high voltage capacitors thereof 71, 72 is the output voltage and thus, the voltage is gradually raised from the input unit to generate the rated high Vpp in the output unit.

In addition, in the Cockcroft-Walton circuit, the same amount voltage as the input voltage is charged into the high voltage capacitors and the sum of the voltage charged into the respective high voltage capacitors is the output voltage, and thus the voltage is gradually raised from the input unit to obtain the desired high DC voltage.

Therefore, the present invention is calibrated in such a way that the cathode 62 of the x-ray tube 60 is closely placed near the input circuit of the Cockcroft-Walton circuit and the anode 61 of the x-ray tube 60 is connected to the output unit of the Cockcroft-Walton circuit high voltage rectification circuit; 70 to maintain the voltage drop ratio of the respective parts in a similar level, thereby restraining discharge phenomenon caused by high voltage although the x-ray tube 60 is closely placed near the high voltage circuit 70.

In accordance with embodiments of the present invention, the high voltage diode 750 and the high voltage capacitor 71, 72 are placed on the circuit board 50 of the high voltage rectification circuit 70 and the x-ray tube 60; refer to FIG. 2 is positioned on the sequence of the parts thereof to innovatively reduce the overall volume of the high voltage tube tank.

Meanwhile, the structure of the housing 80 is also enhanced as the high voltage rectification circuit 70 thereof is composed of the Cockcroft-Walton circuit. With regard to the enhancement, description is made with reference to the figures.

Figure 5:
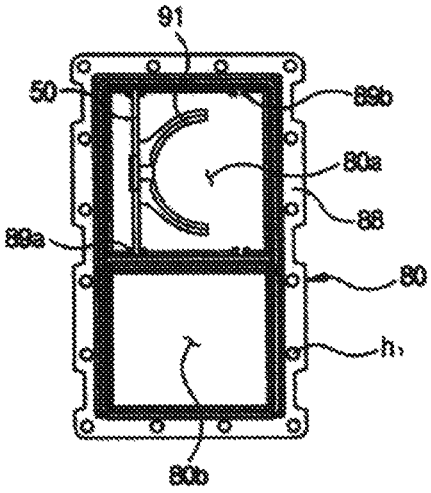
FIG. 5 is a plane diagram of the housing in the high voltage tube tank of portable x-ray system in accordance with an embodiment of the present invention.
Figure 6:
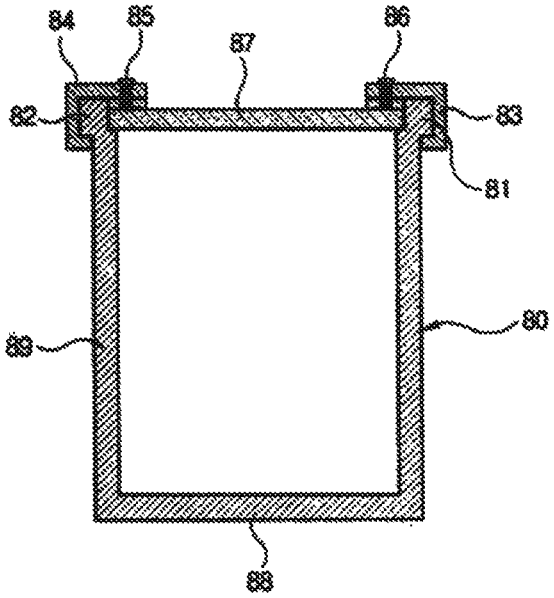
FIG. 6 is a side sectional diagram of the housing in the high voltage tube tank of portable x-ray system in accordance with an embodiment of the present invention.

FIG. 5 is a plane diagram of the housing in the high voltage tube tank of portable x-ray system in accordance with an embodiment of the present invention, and FIG. 6 is a side sectional diagram of the housing in the high voltage tube tank of portable x-ray system in accordance with an embodiment of the present invention.

As illustrated in FIG. 5 and FIG. 6, the housing 80 of the high voltage tube tank of portable x-ray system in the present invention is comprised of the casing 89 with open top and shielded bottom, and the terminal PCB 87 for shielding the open top of the casing 89.

Here, as illustrated in FIG. 6, the elevated platform 82, 83 is built at the open end of the casing 89, wherein the clamp 83 is installed on the elevated platform, enabling the terminal PCB 87 to be fixed by bolts 85 from inside of the casing 89 through the clamp 83, 84. That is, the terminal PCB can be fixed from inner side of the housing 80. Therefore, the existing issue of increased volume caused by fixing the terminal PCB onto the outer edge of the housing frame is solved.

Meanwhile, as illustrated in FIG. 5, the fixing plate 91 may be configured to fix the x-ray tube 60; FIG. 2 inside the housing 80. In FIG. 5, '80*a*' indicates the $1^{st}$ storage space for installing the circuit board 50, and '80*b*' is the $2^{nd}$ storage space for installing the high voltage transformer 20.

In detail, the fixing plate 91 may be configured on the circuit board 50, and as illustrated in FIG. 5, it can be configured in a semicircle terminal shape to fix the x-ray tube 60. In the housing 80, the slot 89*a*, 89*b* is built to install the circuit board 50 for easy installation of the circuit board 50. In addition, the fixing plate 91 is made of insulation materials to protect the x-ray tube 60; FIG. 2 from voltage drop generated in the high voltage rectification circuit 70; FIG. 3. Furthermore, to absorb heat energy generated from the x-ray tube 60, the fixing plate 91 may be configured in such a way that only the bottom area close to the high voltage parts is made of insulation materials, but the top area is open. Accordingly, smooth circulation may be made in the insulating oil stored, and thermal radiation performances of the x-ray tube may be improved 60.

Meanwhile, as illustrated in FIG. 6, the lower inner wall 88 on the anode 61 area of the x-ray tube 60; FIG. 2 stored in the housing 80 may be built thicker than other inner walls for better insulation effects. It is advisable to apply polypropylene resin for the housing 80 in order to prevent discharge phenomenon caused by weight reduction and high voltage.

Although particular embodiments of the present inventions have been shown and described, it will be understood that it is not intended to limit the present inventions to the described embodiments, and it will be obvious to those skilled in the art that various changes and modifications may be made without departing from the spirit and scope of the present inventions stated in the scope of claim.

What is claimed is:

1. A high voltage tube tank of portable x-ray system, comprising;

an x-ray tube for generating x-rays, the x-ray tube having an anode end and a cathode end, a high voltage transformer for generating high voltage, a high voltage rectification circuit having a low voltage input and a high voltage output for transforming and boosting AC voltage to DC voltage and a housing for storing the x-ray tube, the high voltage transformer and the high voltage rectification circuit thereof, wherein;

the high voltage rectification circuit is comprised of multiple high voltage capacitors linearly aligned on both sides of a) circuit board and a high voltage diode built between adjacent high voltage capacitors, such that the low voltage input of the high voltage rectification circuit is located adjacent the cathode end of the x-ray tube and the high voltage output of the high voltage rectification circuit is located adjacent the anode end of the x-ray tube, the circuit board having secured thereto a fixing plate to install the x-ray tube in such a way that the x-ray tube is placed on the fixing plate between the high voltage capacitors.

2. The high voltage tube tank of portable x-ray system of claim 1, wherein; the housing, includes a casing with an open top and a shielded bottom, and a terminal PCB for shielding the open top, wherein;

an elevated platform is built at the open top of the casing, and a clamp is installed at the elevated platform to fix the terminal PCB from inside of the casing through the clamp.

3. The high voltage tube tank of portable x-ray system of claim 2, wherein; an inner wall of the housing placed on the anode end of the x-ray tube of the housing is thicker than other inner walls of the housing.

4. The high voltage tube tank of portable x-ray system of claim 1, wherein; a slot is built in the housing to retain the circuit board.

5. The high voltage tube tank of portable x-ray system of claim 4, wherein;

the fixing plate is made of insulating materials to protect the x-ray tube from voltage drop generated in the high voltage rectification circuit.

* * * * *